US010334935B2

(12) United States Patent
Chung

(10) Patent No.: US 10,334,935 B2
(45) Date of Patent: Jul. 2, 2019

(54) ONE-TOUCH COMPACT CASE HAVING REFILLABLE STRUCTURE

(71) Applicant: CTK CO. LTD., Seongnam-si, Gyeonggi-do (KR)

(72) Inventor: In Yong Chung, Seoul (KR)

(73) Assignee: CTK CO. LTD., Seongnam-si, Gyeonggi-Do (KR)

( * ) Notice: Subject to any disclaimer, the term of this patent is extended or adjusted under 35 U.S.C. 154(b) by 118 days.

(21) Appl. No.: 14/766,734

(22) PCT Filed: Apr. 30, 2015

(86) PCT No.: PCT/KR2015/004425

§ 371 (c)(1),
(2) Date: Aug. 7, 2015

(87) PCT Pub. No.: WO2016/035968

PCT Pub. Date: Mar. 10, 2016

(65) Prior Publication Data

US 2018/0199693 A1 Jul. 19, 2018

(30) Foreign Application Priority Data

Sep. 1, 2014 (KR) ..... 10-2014-0115414

(51) Int. Cl.
*A45D 33/00* (2006.01)
*A45D 40/22* (2006.01)

(52) U.S. Cl.
CPC ..... *A45D 40/221* (2013.01); *A45D 33/006* (2013.01); *A45D 2200/051* (2013.01)

(58) Field of Classification Search
CPC ..... A45D 40/221; A45D 33/006; A45D 2200/051; A45D 33/003; A45D 33/005;
(Continued)

(56) References Cited

U.S. PATENT DOCUMENTS 2,568,365 A * 9/1951 Root ..... A45D 40/221 220/324
2,866,467 A * 12/1958 Bradford ..... A45D 33/006 132/303

(Continued)

FOREIGN PATENT DOCUMENTS

JP 2009-195285 A 9/2009
KR 20-0427803 Y1 9/2006

(Continued)

*Primary Examiner* — Nicholas D Lucchesi
(74) *Attorney, Agent, or Firm* — John K. Park; Park Law Firm

(57) ABSTRACT

The present invention relates to a compact case including an upper cover unit and a lower body for hermetically accommodating various types of cosmetics in which the upper cover unit and the lower body are combined by a pin. The lower body and the upper cover unit are separably combined by a pin for refilling, the lower body is hermetically sealed with a cut plate that can be cut at the top and with a bottom plate at the bottom after a cosmetic is put into the lower body, and the cut plate is cut and opened for use in a single motion by pulling a ring. Accordingly, the compact case is simply sealed and opened, so efficiency including economical efficiency is improved.

8 Claims, 6 Drawing Sheets

(58) Field of Classification Search
CPC ..... A45D 33/02; A45D 2200/056; A45D 40/0075; A45D 40/22; A45D 33/34; A45D 33/16
See application file for complete search history.

(56) References Cited

U.S. PATENT DOCUMENTS

| | | | | |
|---|---|---|---|---|
| 9,867,447 | B1 * | 1/2018 | Kim | A45D 40/24 |
| 2009/0272399 | A1 * | 11/2009 | Kim | A45D 33/008 132/293 |
| 2010/0319724 | A1 * | 12/2010 | Chung | A45D 33/20 132/295 |
| 2011/0048443 | A1 * | 3/2011 | Pires | A45D 33/003 132/200 |
| 2016/0073761 | A1 * | 3/2016 | Lee | A45D 33/025 132/298 |
| 2017/0006995 | A1 * | 1/2017 | Lin | A45D 33/003 |

FOREIGN PATENT DOCUMENTS

| | | | |
|---|---|---|---|
| KR | 20-2011-0007756 | U | 8/2011 |
| KR | 10-1355364 | B1 | 1/2014 |
| KR | 20-0471807 | Y1 | 3/2014 |

* cited by examiner

[Fig. 1]
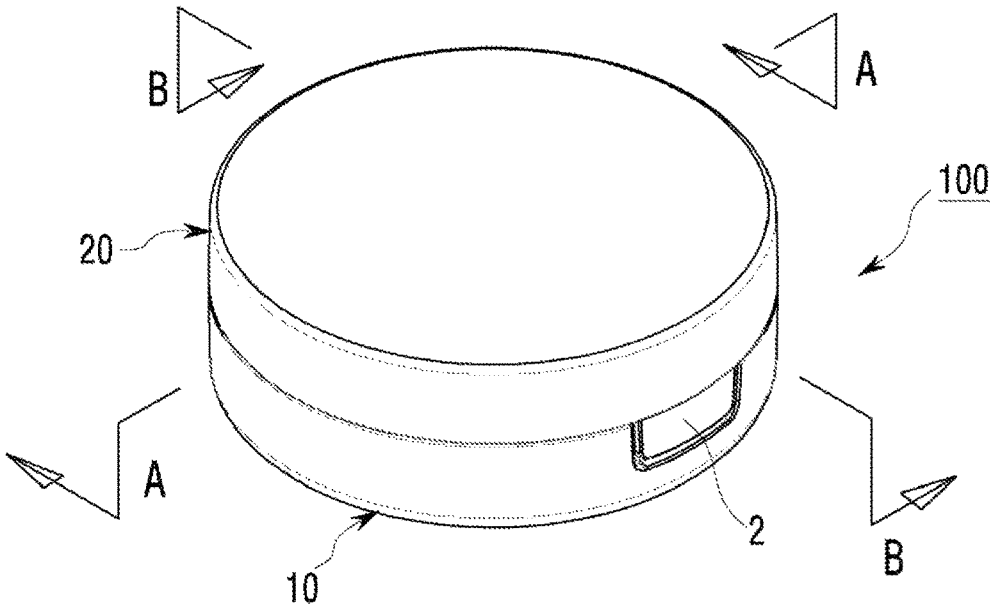
[Fig. 2]
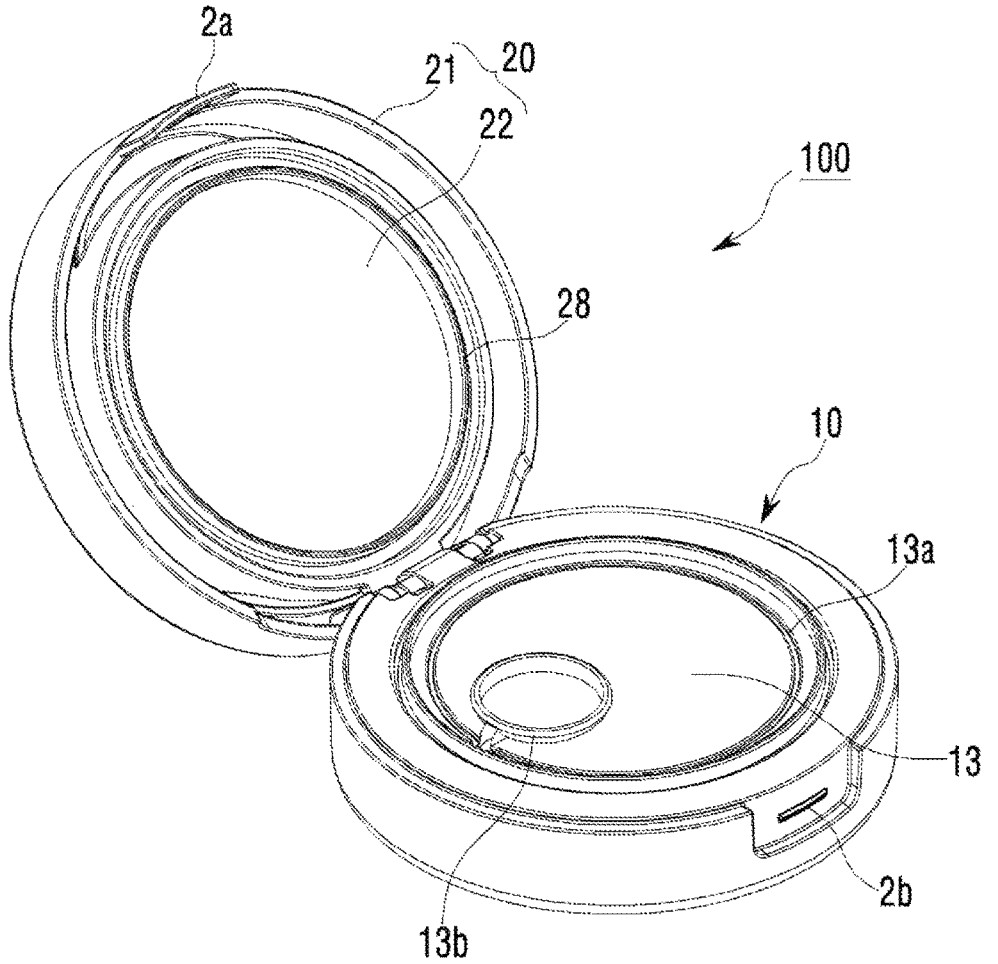

[Fig. 3]
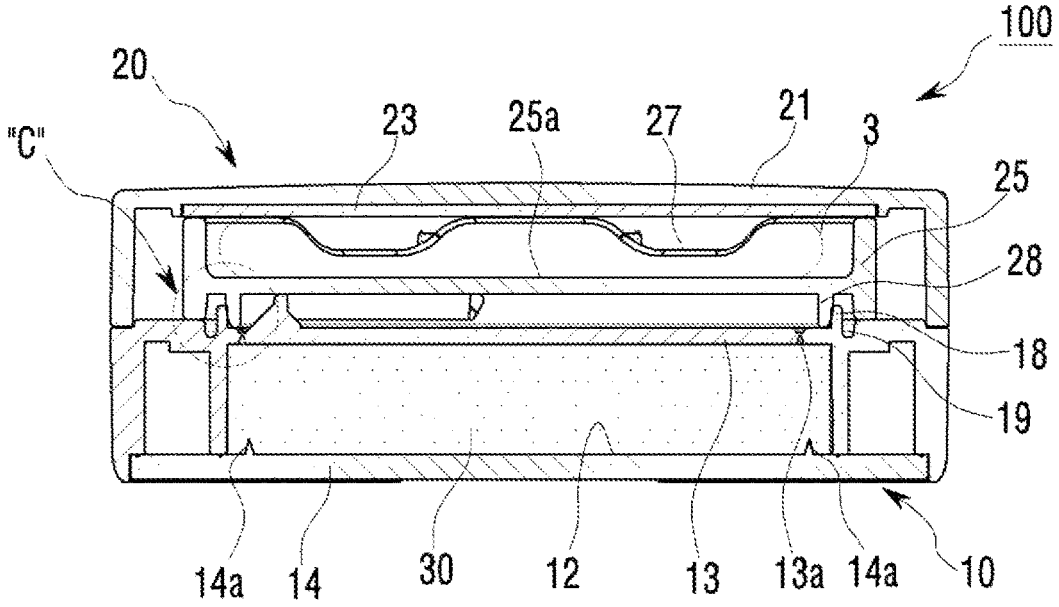
[Fig. 4]
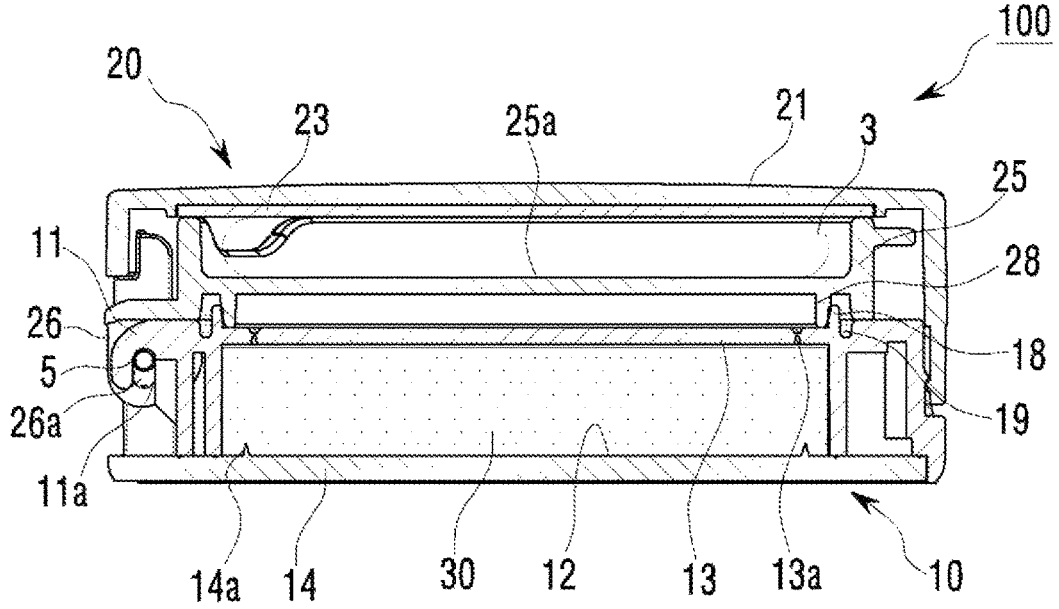

[Fig. 5]
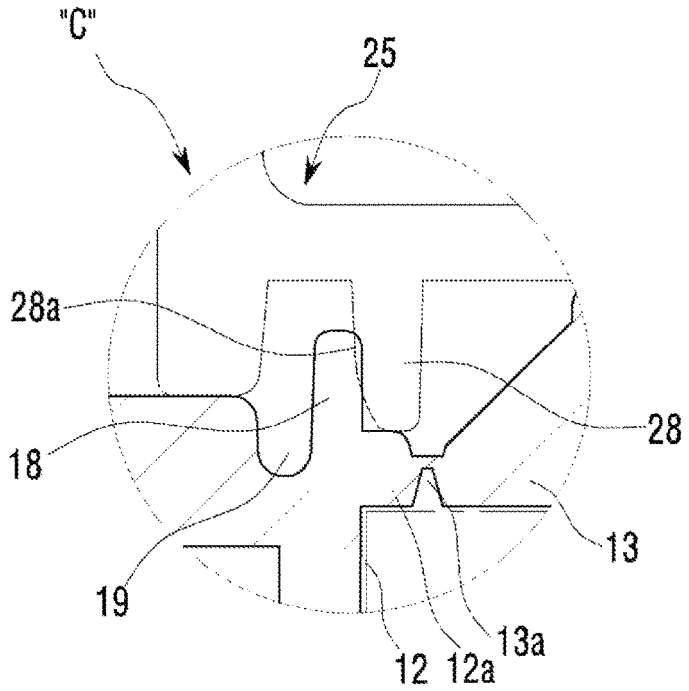
[Fig. 6]
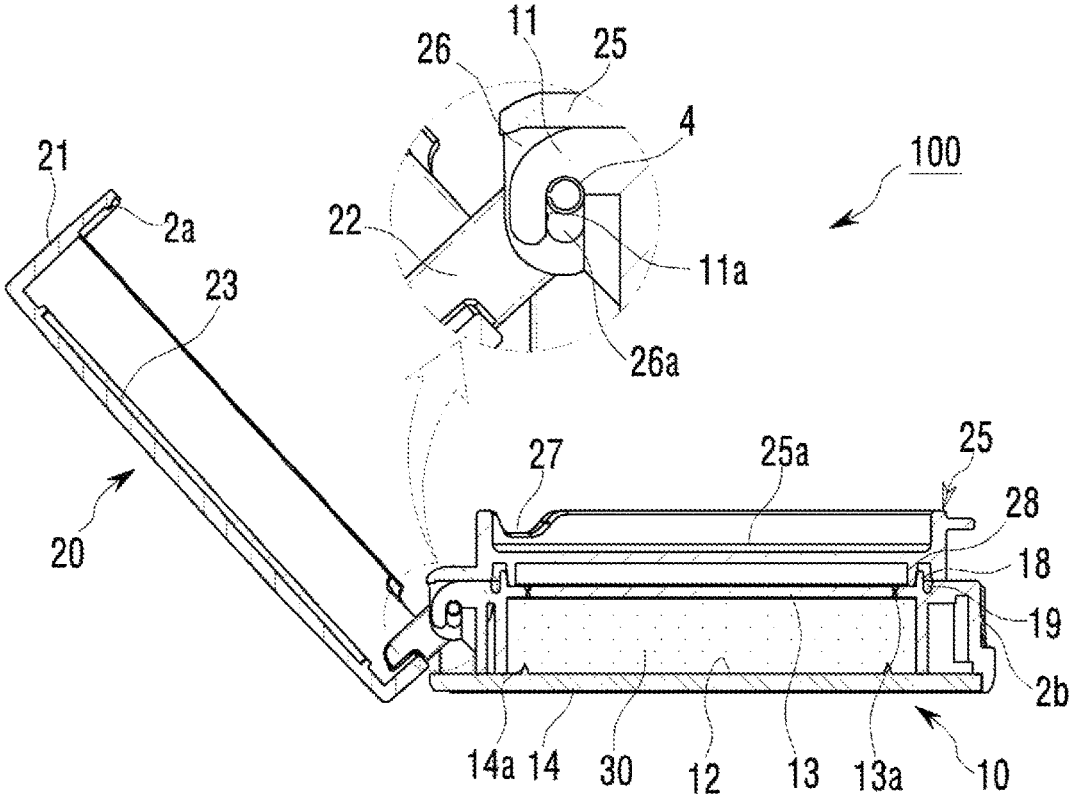

[Fig. 7]
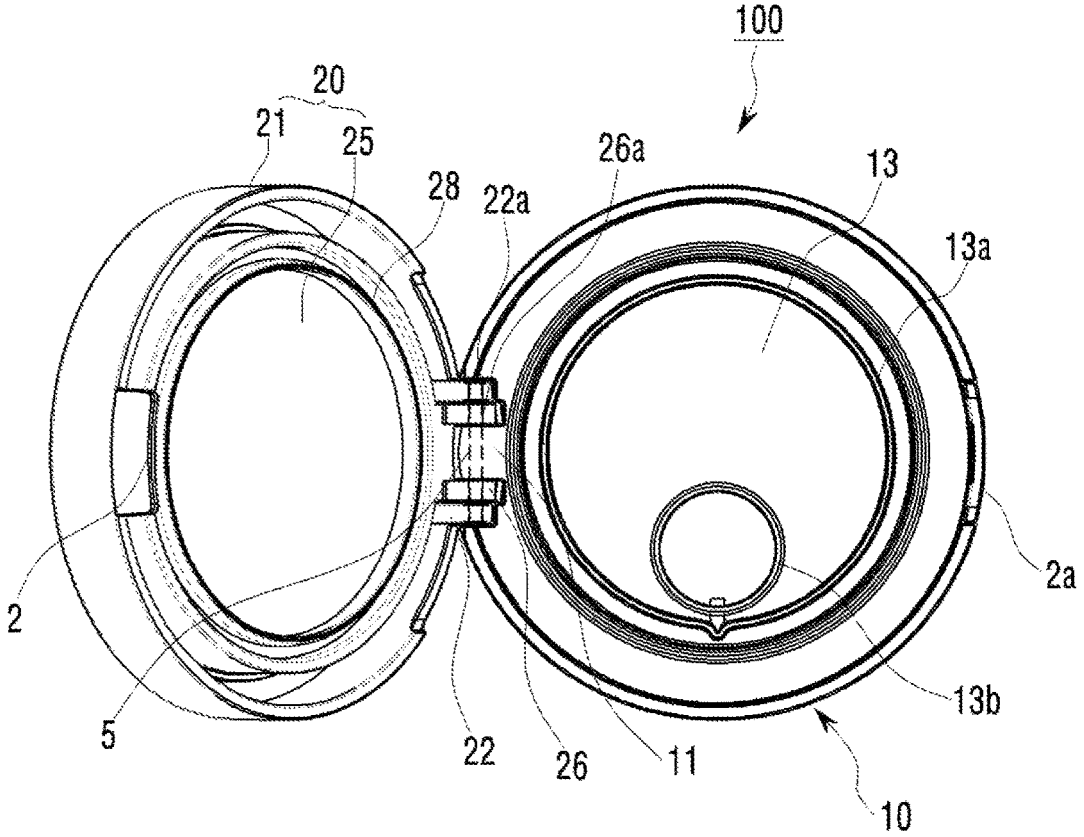

[Fig. 8]
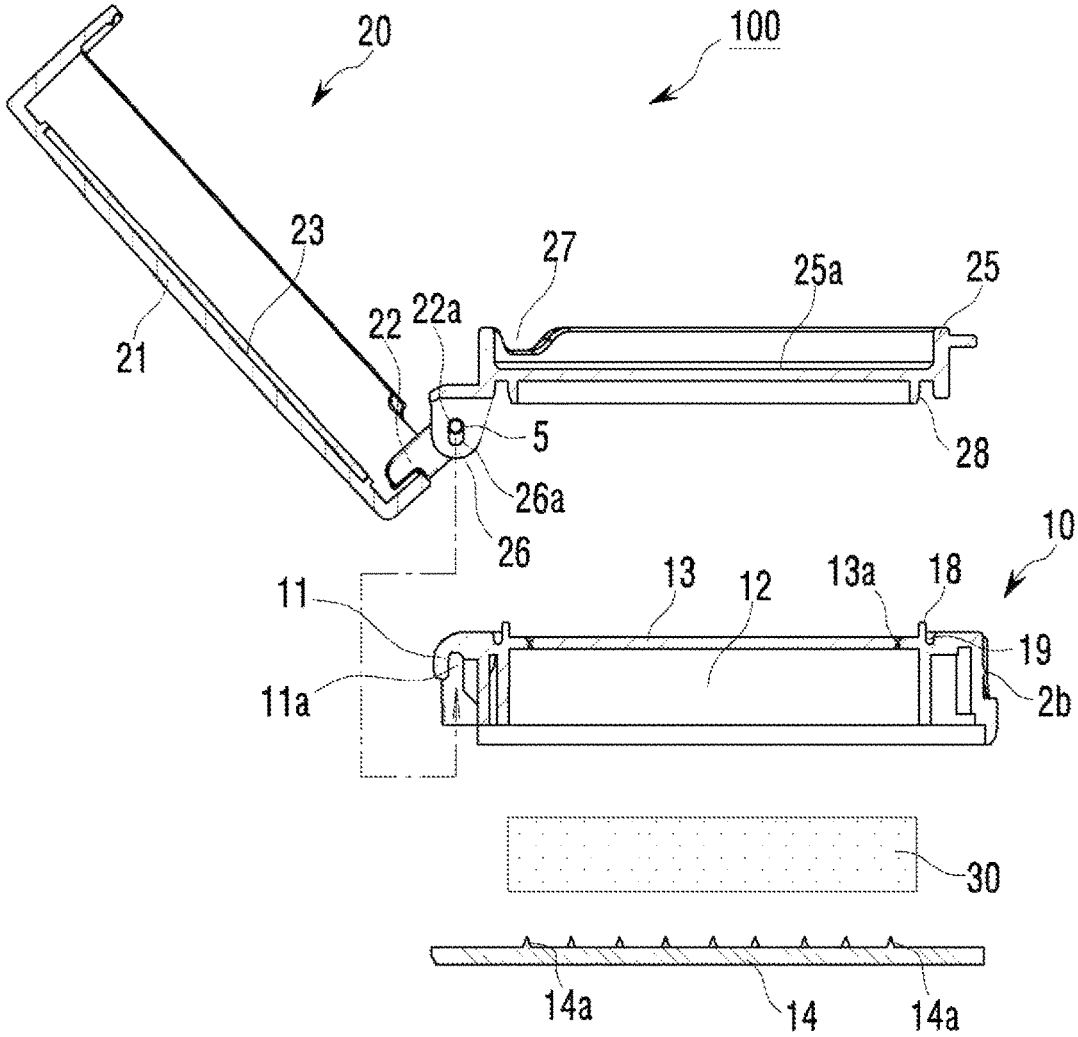

[Fig. 9]
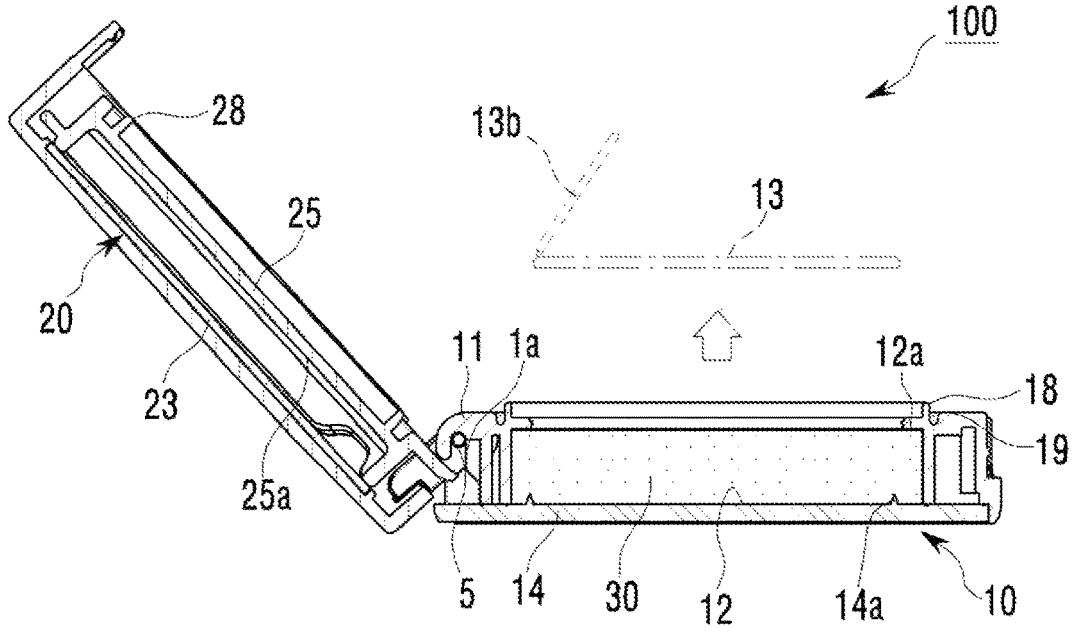

ONE-TOUCH COMPACT CASE HAVING REFILLABLE STRUCTURE

TECHNICAL FIELD

The present invention relates to a compact case including an upper cover unit and a lower body for hermetically accommodating various types of cosmetics in which the upper cover unit and the lower body are combined by a pin. More particularly, the present invention relates to a one-touch compact case having a refillable structure that can be simply hermetically packed and opened, because a lower body and an upper cover unit are separably combined by a pin for refilling, the lower body is hermetically sealed with a cut plate that can be cut at the top and with a bottom plate at the bottom after a cosmetic is put into the lower body, and the cut plate is cut and opened for use in a single motion by pulling a ring.

BACKGROUND ART

In general, a compact is a portable cosmetic.

A compact has a cosmetic material such as a solid-state powder in a case and is carried by people so that they can apply makeup with a puff with the aid of a mirror inside a lid.

Compacts are easy to carry due to a relatively small volume and are manufactured in various designs, including a circle or a rectangle, and their functions have also been developed in various ways.

However, existing compacts are also limited in usage despite their convenience. That is, they are usually limited to accommodating only powder-type cosmetic materials. Therefore their usage needs to be expanded.

In this respect, recently, separate refilling cases have been designed to be put into compact cases, and for the refilling cases, there have been proposed compact cosmetic containers for keeping a cosmetic containing a liquid cosmetic material impregnated in a carrier, for example a porous pad such as a sponge or a urethane foam, that is, a so-called air cushion cosmetic, including a powder cosmetic.

However, these compact cosmetic containers require the separate manufacture of a refilling case in order to keep an air cushion cosmetic and have a structure composed of at least three or more pieces of a body for accommodating an air cushion cosmetic, a lid hinged to the body to open/close it, a covering for keeping the air cushion cosmetic in the body, and a base for supporting the air cushion cosmetic within the body.

Accordingly, the refilling cases of the related art are complicated in structure and compacts for keeping them are necessarily complicated in structure because they are manufactured to fit the refilling cases, so the manufacturing cost is unnecessarily increased.

Further, various hermetic structures for hermetically coupling a lid to the body of a refilling case have been proposed, but they fail to achieve effective airtightness. Therefore, there is a limit in preventing vaporization of water from air cushion type cosmetics, so it is urgently required to solve this problem.

RELATED ART DOCUMENT (Patent Document 1) Korean Patent No. 10-1318467

DISCLOSURE OF INVENTION

Technical Problem

Accordingly, the present invention has been made keeping in mind the above problems occurring in the related art, and the present invention is intended to propose a one-touch compact case having a refillable structure that includes an upper cover unit and a lower body for accommodating various types of cosmetics such as a powder, a liquid-state or a solid-state foundation, and an air cushion cosmetic of a porous pad type impregnated with a liquid cosmetic material and that can be simply hermetically packed and opened for use, because the lower body and the upper cover unit are separably combined by a pin for refilling, the lower body is hermetically sealed with a cut plate that can be cut at the top and with a bottom plate at the bottom after a cosmetic is put into the lower body, and the cut plate is cut and opened for use in a single motion by pulling a ring.

Solution to Problem

In order to achieve the above object, according to one aspect of the present invention, there is provided a one-touch compact case having a refillable structure that includes a lower body and an upper cover unit having a cover and a lid inside the cover, in which the lower body and the upper cover unit are divided into halves and combined up and down, and predetermined sides of the lower body and the upper cover unit are combined by a pin and the other sides are locked and unlocked by a locking unit so that the upper cover unit is opened/closed from/to a top of the lower body, in which the upper cover unit is combined with or separated for refilling from the lower body, by inserting a pin into pin holes formed through ribs at predetermined sides of the cover and the lid and inserting or taking the pin into or out of a pin groove open downward at a rib at a side of the lower body, and the lower body receives and packs various cosmetics, in which a top of the storage space is hermetically closed by a cut plate having a circular cut line and a ring for cutting on the top and a bottom of the storage space is open and hermetically closed by hermetically bonding a bottom plate after various cosmetics are received in the storage space so that the cut plate is pulled with the ring for use in a single motion.

The pin may be a spring pin.

The lid may have a vent outside a puff space for accommodating a puff at an upper portion.

A ring-shaped hermetic protrusion may be formed on a bottom of the lid and brought hermetically in contact with an inner side of a hermetic protrusion on the top of the lower body, and the hermetic protrusion of the lid may have a down-inclined surface on an outer side.

A ring-shaped groove may be formed around outside the hermetic protrusion of the lower body and the hermetic protrusion may be hermetically tensed inward and outward.

A fixing protrusion for preventing the cosmetic in the storage space of the lower body from moving may be formed on a top of the bottom plate.

The cosmetic to be received in the storage space of the lower body may be any one of a powder, a liquid-state or a solid-state foundation, and an air cushion cosmetic of a porous pad type impregnated with a liquid cosmetic material.

The cut line of the cut plate may be formed such that a stepped portion is formed inside the top of the storage space so that a cosmetic accommodated in the storage space is held without separating to the outside.

Advantageous Effects of Invention

According to the present invention having the above-described characteristics, since the lower body and the upper cover unit are separably combined by the pin and the entire lower body is separated for refilling without a specific refilling structure in a lower body, as in the related art, it is possible to simply open and easily refill the compact case.

Further, since the lower body for accommodating various cosmetics is hermetically sealed with a cut plate that can be cut at the top and with a bottom plate at the bottom after a cosmetic is put into the lower body, it is possible to prevent deterioration of the cosmetic. Additionally, since the compact case is opened in a single motion by pulling the ring to cut the cut plate for use, it can be simply opened.

Further, since air can smoothly flow to the puff inside the lid of the cover unit, it is possible to prevent mold and bacterial growth. Furthermore, since the lid and the body are hermetically combined, it is possible to prevent deterioration or leakage of a cosmetic material.

BRIEF DESCRIPTION OF DRAWINGS

FIG. 1 is a perspective view showing the external appearance of compact according to an embodiment of the present invention.

FIG. 2 is a perspective view showing the compact shown in FIG. 1, with an upper cover unit open.

FIGS. 3 and 4 are cross-sectional views taken along lines A-A and B-B shown in FIG. 1, respectively.

FIG. 5 is a partial enlarged view of the portion C of FIG. 3.

FIG. 6 is a cross-sectional view showing the compact with the cover unit open.

FIG. 7 is a plan view showing the compact with the cover unit open.

FIG. 8 is an exploded cross-sectional view showing the compact.

FIG. 9 is a cross-sectional view showing operation for opening a cut plate from body of the compact.

MODE FOR THE INVENTION

Reference will now be made in greater detail to an exemplary embodiment of the present invention, an example of which is illustrated in the accompanying drawings. Wherever possible, the same reference numerals will be used throughout the drawings and the description to refer to the same or like parts.

Hereinafter, exemplary embodiments of the present invention will be described in detail with reference to the accompanying drawings.

A one-touch compact case 100 having refillable structure according to an embodiment of the present invention includes, as shown in FIGS. 1 to 8, a lower body 10 and an upper cover unit 20 having a cover 21 and a lid 25 inside the cover 21, in which the lower body 10 and the upper cover unit 20 are divided into halves.

Predetermined sides of the lower body 10 and the upper cover unit 20 are combined by a pin and the other sides are locked and unlocked by a locking unit 2, so the upper cover unit 20 can be opened/closed from/to the top of the lower body 10.

In particular, the upper cover unit 20 is combined with or separated for refilling from the lower body 10, by inserting a pin 5 into pin holes 22*a* and 26*a* formed through ribs 22 and 26 at predetermined sides of the cover 21 and the lid 25 and inserting or taking the pin 5 into or out of the pin groove 11*a* that is open downward at a rib 11 at a side of the lower body 10.

The pin 5 is a spring pin elastically inserted in the pin groove 11 of the lower body 10 to prevent separation and the pin holes 26*a* may be formed in a vertical oblong shape through the ribs 26 of the lid 25 of the upper cover unit 20 such that the lid can be moved vertically and rotated.

The lower body 10 receives and packs various types of cosmetics 30 in a storage space 12 therein and the top of the storage space 12 is hermetically closed by a cut plate 13 having a circular cut line 13*a* and a ring 13*b* for cutting.

The cosmetics 30 that are received and packed in the storage space 12 may be various types. For example, the cosmetics may be, in addition to a powder, a liquid-state or a solid-state foundation, and an air cushion cosmetic of a porous pad type impregnated with a liquid cosmetic material.

The cut line 13*a* of the cut plate 13 is formed by vertically forming grooves such that the cut plate 13 becomes thin for cutting, so a user can simply open the cut plate 10 by pulling the ring in a single motion.

In particular, the cut line 13*a* of the cut plate 13 is formed such that a stepped portion 12*a* is formed inside the top of the storage space 12 so that a cosmetic 30 accommodated in the storage space is held without separating to the outside.

The bottom of the storage space 12 is open and hermetically closed by hermetically bonding a bottom plate 14 after the cosmetic 30 is received in the storage space 12. The storage space 12 may be sealed in various ways such as ultrasonic bonding and the bottom plate 14 that is hermetically bonded to the bottom of the storage space 12 of the lower body 10 such that the entire contact portion is hermetically bonded and airtightness is stably maintained.

The cover 21 of the upper cover unit 20 has a mirror 23 attached on the inner side.

The lid 25 has a puff space 25*a* for accommodating a puff 3 on the top and a vent 27 formed outside the puff space 25*a* for drying the puff 3 to prevent mold or bacterial growth due to humidity.

A ring-shaped hermetic protrusion 28 is formed on the bottom of the lid 25 and hermetically brought in contact with the inner side of a hermetic protrusion 18 on the top of the lower body 10. The hermetic protrusion 28 of the lid 25 has a down-inclined surface 28*a* on the outer side and a ring-shaped groove 19 is formed around outside the hermetic protrusion 18 of the lower body 10, so the hermetic protrusion is hermetically tensed inward and outward.

That is, the cover 21 of the upper cover unit 20 presses the lid 25 and the lid 25 presses the top of the lower body 10, thereby achieving a hermetic structure, so moisture in the cosmetic 30 is prevented from vaporizing or leaking.

In particular, when the cosmetic 30 is an air cushion type having a porous pad impregnated with a liquid cosmetic material, a cosmetic manufactured by impregnating a liquid cosmetic material in a porous pad such as a sponge or a urethane foam may be received in the storage space 120 or a liquid cosmetic material may be impregnated into a porous pad in the storage space 120.

According to the present invention, a fixing protrusion 14*a* for preventing the cosmetic in the storage space 12 of the lower body 10 from freely rotating or moving may be formed on the top of the bottom plate 14.

Reference numerals 2*a* and 2*b* not stated above are locking projections of the locking unit 2.

Operation of the present invention having this configuration is described hereafter.

A process of assembling and packing the compact case of the present invention is described first. The cosmetic 30 is put into the storage space 12 inside the lower body 10 through the downward opening.

Then, the storage space 12 is sealed by hermetically bonding bottom plate 14 to the bottom of the lower body 10.

As described above, after the cosmetic 30 is received in the storage space 12 inside the lower body 10, the upper case 20 is combined by a pin. That is, the pin 5 that is a spring pin is inserted into the pin holes 22*a* and 26*a* of the ribs 22 and 26 formed at the sides of the lid 25 and the cover 21 of the upper cover unit 20 and then the pin 5 is inserted into the pin groove 11*a* of the rib 11 at the side of the lower body 10.

Since the pin 5 is a spring pin, it is elastically inserted in the pin groove 11*a* of the lower body 10, and accordingly, the pin 5 is prevented from separating from the pin groove 11*a*.

As described above, the lower body 10 and the upper cover unit 20 are combined and assembled by the pin.

In order to use the cosmetic in the compact case, a user unlocks the locking unit 2 of the cover unit 20 and then opens the cover unit 20 upward about the pin 5.

That is, a user opens upward the lid 25 with the cover 21 of the cover unit 20 about the pin 5.

Then, the user takes out the puff 3 from the puff space 25*a* over the lid 25.

The user opens the storage space 12 with the cosmetic therein by cutting the cut plate 13 at the top of the lower body 10 after opening the cover unit 20.

That is, when the user puts a finger into the ring 13*b* on the cut plate 13 and pulls it upward, the circular cut line 13*a* is cut and the cut plate 13 is simply cut and removed accordingly in a single motion.

After removing the cut plate 13, as described above, the user puts the cosmetic 30 in the storage space 12 on the puff and applies makeup.

Since the cut line 13*a* is formed such that the stepped portion 12*a* is formed inside the storage space, even though the cut plate 13 is removed, the cosmetic 30 in the storage space 12 cannot be unexpectedly separated by the stepped portion 12*a*.

In order to close the cover unit 20 to keep the compact case after using, the user sequentially turns the lid 25 and the cover 21 of the cover unit 20 back to the top of the lower body 10 about the pin 5 and then locks it with the locking unit 2.

In this state, the ring-shaped hermetic protrusion 28 on the bottom of the lid 25 is hermetically in contact with the ring-shaped hermetic protrusion 18 on the top of the lower body 10.

In particular, the hermetic protrusion 28 on the bottom of the lid is in contact with the inner side of the hermetic protrusion 18 on the lower body 10, pressing the inner side with the down-inclined surface 28*a* on its outer side. Further, the hermetic protrusion 18 on the top of the lower body 10 is tensed inward and outward by the ring-shaped groove 19 outside the hermetic protrusion 18 on the top of the lower body 10, so it is hermetically in close contact with the down-inclined surface 28*a* of the hermetic protrusion 28 on the bottom of the lid.

That is, the cover 21 of the upper cover unit 20 presses the lid 25, the lid 25 presses the top of the lower body 10, and the lid 25 and the lower body 10 are hermetically combined by the hermetic protrusions 18 and 28, so moisture in the cosmetic 30 is preserved without vaporizing or leaking.

When the cosmetic in the lower body 10 is used up, it is replaced with a refill.

For refilling, the user separates the upper cover unit 20 and the lower body 10 by taking the spring pin 5, which is in the ribs 22 and 26 at the sides of the cover 21 and the lid 25 of the upper cover unit 20, out of the pin groove 11*a* of the rib 11 at the side of the lower body 10.

In this state, the user can reuse the compact case by combining the upper cover unit 20 back with the lower body for refilling, as described above.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A one-touch compact case having a refillable structure that includes a lower body and an upper cover unit having a cover and a lid inside the cover, the lower body and the upper cover unit being divided into halves and combined up and down, and in which predetermined sides of the lower body and the upper cover unit are combined by a pin and other sides are locked and unlocked by a locking unit so that the upper cover unit is opened and closed from a top of the lower body, wherein the upper cover unit is combined with or separated for refilling from the lower body, through the pin inserted into pin holes formed through ribs at predetermined sides of the cover and the lid and put into or out of a pin groove open downward at a rib at a side of the lower body, and the lower body receives and packs a cosmetic, wherein a top of a storage space is hermetically closed by a cut plate having a circular cut line and a ring for cutting on a top and a bottom of the storage space is open and hermetically closed through a bottom plate that is hermetically bonded after the cosmetic is received in the storage space so that the cut plate is pulled with the ring for use in a single motion.

2. The compact case of claim 1, wherein the pin is a spring pin.

3. The compact case of claim 1, wherein the lid has a vent outside a puff space for accommodating a puff at an upper portion.

4. The compact case of claim 1, wherein a ring-shaped hermetic protrusion is formed on a bottom of the lid and hermetically brought in contact with an inner side of a hermetic protrusion on the top of the lower body, and the hermetic protrusion of the lid has a down-inclined surface on an outer side.

5. The compact case of claim 4, wherein a ring-shaped groove is formed around outside the hermetic protrusion of the lower body and the hermetic protrusion is hermetically tensed inward and outward.

6. The compact case of claim 1, wherein a fixing protrusion for preventing the cosmetic in the storage space of the lower body from moving is formed on a top of the bottom plate.

7. The compact case of claim 1, wherein the cosmetic to be received in the storage space of the lower body is any one of a powder, a liquid-state or a solid-state foundation, and an air cushion cosmetic of a porous pad impregnated with a liquid cosmetic material.

8. The compact case of claim 1, wherein the cut line of the cut plate is formed such that a stepped portion is formed inside the top of the storage space so that a cosmetic accommodated in the storage space is held without separating to the outside.

* * * * *